US006663216B2

(12) United States Patent
Kanaya

(10) Patent No.: US 6,663,216 B2
(45) **Date of Patent: *Dec. 16, 2003**

(54) FLUSHING CONTROLLER INCORPORATED IN INK-JET RECORDING APPARATUS, AND FLUSHING CONTROL METHOD FOR THE SAME

(75) Inventor: Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

This patent is subject to a terminal disclaimer.

(21) Appl. No.: 09/865,577

(22) Filed: May 29, 2001

(65) Prior Publication Data

US 2002/0054183 A1 May 9, 2002

Related U.S. Application Data

(63) Continuation-in-part of application No. 09/440,696, filed on Nov. 16, 1999, now Pat. No. 6,345,878.

(30) Foreign Application Priority Data

Nov. 27, 1998 (JP) ..... 10-338014
May 26, 2000 (JP) ..... P.2000-157016

(51) Int. Cl.[7] ..... B41J 2/165
(52) U.S. Cl. ..... 347/23; 347/35; 347/30
(58) Field of Search ..... 347/23, 22, 29, 347/35, 24, 104, 105, 30, 14, 19

(56) References Cited

U.S. PATENT DOCUMENTS 5,583,547 A 12/1996 Gast et al. ..... 347/22
6,345,878 B1 * 2/2002 Kanaya ..... 347/23

FOREIGN PATENT DOCUMENTS

| | | | |
|---|---|---|---|
| EP | 0 585 923 A2 | 3/1994 | ..... B41J/2/165 |
| EP | 0 724 965 A2 | 8/1996 | ..... B41J/19/18 |
| EP | 0 822 086 A2 | 2/1998 | ..... B41J/2/21 |
| EP | 0 842 779 A2 | 5/1998 | ..... B41J/2/165 |
| JP | 2-108547 | 4/1990 | ..... B41J/2/165 |
| JP | 4-235058 | 8/1992 | ..... B41J/2/18 |

* cited by examiner

*Primary Examiner*—Shih-Wen Hsieh
(74) *Attorney, Agent, or Firm*—Sughrue Mion, PLLC

(57) ABSTRACT

A flushing determination section 55 determines whether a flushing operation is to be performed, on the basis of a paper size recognized by a paper width recognizer and a traveling direction detected by a carriage traveling direction detector. In this case, a threshold value produced by threshold value determination section is set so as to assume different values according to the traveling direction of the carriage. The probability of recording heads being subjected to flushing in the vicinity of the home position is made greater while required flushing intervals are maintained. Consequently, print throughput on recording paper of comparatively large size is improved, and the traveling range of the carriage can be reduced.

42 Claims, 9 Drawing Sheets

FLUSHING CONTROLLER INCORPORATED IN INK-JET RECORDING APPARATUS, AND FLUSHING CONTROL METHOD FOR THE SAME

CROSS-REFERENCE TO RELATED APPLICATION

This is a continuation-in-part application of U.S. patent application Ser. No. 09/440,696 filed on Nov. 16, 1999. Now U.S. Pat. No. 6,345,878 B1.

BACKGROUND OF THE INVENTION

The present invention relates to an ink-jet recording apparatus which comprises an ink-jet type recording head mounted on a carriage, which travels in a widthwise direction of recording paper, and ejects ink droplets toward the recording paper so as to correspond to print data. More particularly, the present invention relates to a flushing controller suitable for use with a recording apparatus which records an image on paper having a large width.

Ink-jet recording apparatus can print small dots with a comparatively low noise level at high density, and hence they have recently been used in many printing applications, including color printing. Such an ink-jet recording apparatus comprises an ink-jet recording head which receives ink supplied from an ink cartridge, and paper feeder for feeding a recording sheet relative to the recording head. Text or an image is recorded on the recording sheet by causing the recording head to eject ink droplets to the recording paper while the recording head travels together with a carriage in a widthwise direction of the recording sheet. For example, a black recording head for ejecting black ink and a color recording head capable of ejecting various colors of ink, such as yellow, cyan, and magenta, are mounted on a single recording head. The ink-jet recording apparatus enables full-color printing through use of black ink, as well as printing of text, by changing the proportions of color inks to be ejected.

Such an ink-jet recording head performs a printing operation by ejecting ink, which is pressurized in a pressure generating chamber, as ink droplets by way of a nozzle. The ink-jet recording head suffers problems such as printing failures, which are caused by an increase in the viscosity of ink due to evaporation of a solvent by way of nozzle orifices, solidification of ink, adhesion of dirt or dust on the nozzle, or mixing of air bubbles into ink. In order to prevent the printing failures, the ink-jet recording apparatus is equipped with a capping unit for sealing the nozzle orifices of the recording head while the recording apparatus is in a non-printing mode In the event that the nozzle orifices are clogged, the capping unit eliminates clogging in the nozzle orifices caused by solidification of ink or an ink ejecting failure due to mixing of air bubbles into the ink flow channel, by means of sealing the nozzle plate through use of a cap unit and suctioning ink by means of negative pressure imparted by a suction pump by way of the nozzle orifices. Further, the capping unit also has the function of preventing drying of the ink remaining in the nozzle orifices while the recording apparatus is in a non-printing mode.

Forced discharging operation, which is performed in order to eliminate clogging in the recording head or air bubbles mixed into the ink flow channel, is called cleaning operation. The cleaning operation is performed when a printing operation is resumed after the recording apparatus has remained in an idle mode for a long period of time or when the user actuates a cleaning switch after observing degradation in the quality of a recorded image. The cleaning operation involves removal of ink droplets from the recording head by means of negative pressure applied through suction.

The capping unit also has a capability of ejecting ink droplets by application to the recording head of a drive signal that is irrelevant to printing. This function is called flushing operation. The flushing operation is performed at predetermined cycles for the purposes of: recovering meniscuses, which are irregularly formed in the vicinity of nozzle orifices of the recording head as a result of wiping action of a wiping blade during the cleaning operation; and preventing clogging in the nozzle orifices from which a small amount of ink droplets is ejected during a printing operation, which would otherwise be caused by an increase in the viscosity of ink.

There has recently arisen a demand for a large-sized ink-jet recording apparatus which uses as a recording medium, for example, a roll sheet having a width of 40 inches or more. The width and height of the recording apparatus are inevitably increased, and development of a recording apparatus which requires an operator to perform operations while remaining in a standing position is on the horizon. In the design of such a large-sized recording apparatus, consideration must be paid to enabling images to be printed on paper having the maximum width, as well as on, e.g., A3-size paper.

Recording paper having various widths is loaded on the recording apparatus with reference to the home position, where capping unit is disposed, and awaits the recording head. The carriage having the recording head mounted thereon is controlled so as to travel back and forth in the widthwise direction of the thus-loaded recording paper. Consequently, the distance over which the carriage travels can be reduced, thereby improving throughput of the recording apparatus.

In association with an increase in the capability of producing a large volume of prints and an increase in print speed, the recording apparatus must work with a large amount of ink to be discharged, even during the cleaning and flushing operations for the purpose of recovering the print function of the recording head. Because of such a necessity, the capping unit, which performs cleaning operation in conjunction with flushing operation, becomes unable to discharge a large amount of waste ink.

For this reason, dedicated flushing regions are desirably provided on opposite sides of a print area, and the recording head is subjected to flushing in these flushing regions. If the recording head is subjected to flushing while traveling at an accelerated speed at the start of print operation, throughput of the recording apparatus can be further improved.

In the above-described recording apparatus, in consideration of improvement in throughput, flushing of the recording heads is desirably limited to within the flushing region located close to the home position where the capping unit is disposed. Desirably, the recording apparatus is controlled so as to determine whether to periodically perform the flushing operation, according to the width of the paper loaded on the recording apparatus and according to whether or not printing is performed along single pass from the home position.

Meanwhile, a threshold value to be used for determining whether or not flushing operation has been performed is selected to be as great as possible, so as to prevent print throughput from being lowered. In order to ensure reliability of printing operation, flushing operation must be effected at a point in time when printing operation for one path is commenced, such that a flushing operation cycle comes during a print period corresponding to the next path, possibly even before a flushing operation cycle has come.

SUMMARY OF THE INVENTION

The present invention has been conceived on the basis of the foregoing technical grounds, and the object of the present invention is to provide a flushing control method and a flushing controller, which are applied to a recording apparatus capable of working with comparatively wide recording paper and which enable improvement in throughput.

It is another object of the invention to provide an ink-jet recording apparatus capable of performing flushing operation, so as to ensure print reliability regardless of a print mode or the width of recording paper and without involvement of a decrease in throughput.

In order to achieve the above objects, according to the present invention, there is provided an ink-jet recording apparatus comprising:

an ink-jet recoding head mounted on a carriage reciprocatively moving in a width direction of a loaded recording medium having a printing region on which an image is to be recorded;

a first and a second flushing regions situated opposite ends of the printing region in which a flushing operation of the recording head is performed;

means for recognizing the width of the recording medium;

means for detecting the moving direction of the carriage; and means for determining whether the flushing operation is performed in accordance with width data recognized by the width recognizing means and direction data detected by the direction detecting means.

Preferably, the flushing determination means receives a print start instruction as an activation trigger.

Preferably, the ink-jet recording apparatus further comprises: means for physically detecting the width of the recording medium; and means for logically detecting the width of the recording medium from an input data into a printer driver. The width recognition means selects data having smaller width value from the width data detected by the physical detection means and the logical detection means.

According to the present invention, there is also provided an ink-jet recording apparatus comprising:

an ink-jet recoding head mounted on a carriage reciprocatively moving in a width direction of a loaded recording medium having a printing region on which an image is to be recorded;

a first and a second flushing regions situated opposite ends of the printing region in which a flushing operation of the recording head is performed;

means for detecting the moving direction of the carriage;

a timer for counting a time period elapsed from a completion of printing for each single pass;

means for determining whether the flushing operation is performed in accordance with width direction data detected by the direction detecting means when the timer counts a predetermined time period.

Preferably, in the above apparatuses, the flushing determination means further determines that the flushing operation is performed at the first or the second flushing region in accordance with the width data and the direction data.

According to the present invention, there is also provided a flushing controller incorporated in an ink-jet recording apparatus which comprises:

an ink-jet recoding head mounted on a carriage reciprocatively moving in a width direction of a loaded recording medium having a printing region on which an image is to be recorded; and a first and a second flushing regions situated opposite ends of the printing region in which a flushing operation of the recording head is performed, comprising:

means for recognizing the width of the recording medium;

means for detecting the moving direction of the carriage; and means for determining whether the flushing operation is performed in accordance with width data recognized by the width recognizing means and direction data detected by the direction detecting means.

According to the present invention, there is also provided a flushing controller incorporated in an ink-jet recording apparatus which comprises:

an ink-jet recoding head mounted on a carriage reciprocatively moving in a width direction of a loaded recording medium having a printing region on which an image is to be recorded; and a first and a second flushing regions situated opposite ends of the printing region in which a flushing operation of the recording head is performed, comprising:

means for detecting the moving direction of the carriage;

a timer for counting a time period elapsed from a completion of printing for each single pass;

means for determining whether the flushing operation is performed in accordance with width direction data detected by the direction detecting means when the timer counts a predetermined time period.

Preferably, in the above apparatuses, the flushing determination means has different threshold values for the determination in accordance with the moving direction of the carriage, and determines that the flushing operation is performed when time period elapsed from a completion of previous flushing operation exceeds the threshold value.

In this case, the threshold value considered when the carriage moves toward a home position of the recording head is larger than the threshold value considered when the carriage moves from the home position. Preferably, one of the threshold values includes a delay factor for delaying the carriage starting every single pass of print scanning for a time period which is enough to dry the ink of previous pass.

In this case, preferably, the difference between the threshold values includes the delay factor, a time period required for single pass of printing on the recording medium, and a predetermined margin.

Preferably, the above controllers further comprise: means for physically detecting the width of the recording medium; and means for logically detecting the width of the recording medium from an input data into a printer driver. The width recognition means selects data having smaller width value from the width data detected by the physical detection means and the logical detection means.

Preferably, in the above controllers, the flushing determination means further determines that the flushing operation is performed at the first or the second flushing region in accordance with the width data and the direction data.

According to the present invention, there is also provided a flushing control method used for an ink-jet recording apparatus which comprises:

an ink-jet recoding head mounted on a carriage reciprocatively moving in a width direction of a loaded recording medium having a printing region on which an image is to be recorded; and a first and a second flushing regions situated opposite ends of the printing region in which a flushing operation of the recording head is performed, comprising the steps of:

recognizing the width of the recording medium;

detecting the moving direction of the carriage; and determining whether the flushing operation is performed in accordance with width data recognized by the width recognizing step and direction data detected by the direction detecting step.

Preferably, execution of the steps is activated by a print start instruction.

Preferably, the method further comprises the steps of:

detecting the width of the recording medium physically;

detecting the width of the recording medium logically from an input data into a printer driver; and selecting data having smaller width value from the width data detected by the physical detection step and the logical detection step as the width data.

According to the present invention, there is also provided a flushing control method used for an ink-jet recording apparatus which comprises:

an ink-jet recoding head mounted on a carriage reciprocatively moving in a width direction of a loaded recording medium having a printing region on which an image is to be recorded; and a first and a second flushing regions situated opposite ends of the printing region in which a flushing operation of the recording head is performed, comprising the steps of:

counting a time period elapsed from a completion of printing for each single pass;

detecting the moving direction of the carriage when a predetermined time period is counted; and determining whether the flushing operation is performed in accordance with width direction data detected by the direction detecting step.

Preferably, in the above methods, the flushing determination step further determines that the flushing operation is performed at the first or the second flushing region in accordance with the width data and the direction data.

According to the above configuration, a determination is made as to whether or not flushing operation is to be performed, according to at least the direction in which the carriage is to travel in the next printing operation. Consequently, the determination can be made with estimation of the time required to print the next single pass. Flushing intervals required by the recording heads can be ensured, and reliable printing can be ensured.

In addition, the threshold value to be compared with the time elapsed from completion of the previous flushing operation is set to different values according to the traveling direction of the carriage. For example, the threshold value can be controlled such that the probability of the recording heads being subjected to flushing within the flushing box in the vicinity of the home position is increased, thus ensuring reliable printing and improving printer throughput while the range of travel of the carriage is reduced.

According to the present invention, there is also provided an ink jet recording apparatus comprising:

an ink jet recording head mounted on a carriage reciprocatively moving in a width direction of a loaded recording medium having a printing region on which image is recorded;

at least one flushing region situated at least one of opposite side ends of the printing region, in which a flushing operation of the recording head is performed;

means for setting a reference value which is determined in accordance with a first time period required for the carriage to travel a width dimension of the loaded recording medium;

means for setting a threshold value, which is used for determining whether the flushing operation is performed, in accordance with the reference value;

a timer which is reset when the flushing operation is performed; and means for determining whether the flushing operation is performed by comparing the threshold value and a time period counted by the timer.

Preferably, the reference value is determined in accordance with the width dimension of the loaded recording medium.

Further, it is preferable that the reference value is determined in accordance with a moving speed of the carriage.

Still further, it is preferable that the reference value is determined in accordance with a second time period which is obtained by subtracting the first time period from a maximum time interval between succeeding flushing operations.

Preferably, the recording medium is loaded such that a reference position thereof is placed in a side of which a home position of the carriage is situated. Here, the threshold value determination means has different threshold values in accordance with the moving direction of the carriage. A first threshold value used for a printing when the carriage moves from the home position is smaller than a second threshold value used for a printing when the carriage moves toward the home position.

Here, it is preferable that the first threshold value is obtained by subtracting a predetermined value from the reference value.

Preferably, the at least one flushing region includes a first flushing region which is situated in one side end of the printing region where a home position of the carriage is placed, and a second flushing region which is situated in the other side end of the printing region. Here, the recording apparatus further comprises means for selecting the first flushing region or the second flushing region where the flushing operation is performed when the flushing operation determination means determines the flushing operation is required.

In the above configurations, the reference value is decreased as the carriage travel time of the carriage becomes longer, in accordance with the width dimension of recording paper loaded on the recording apparatus and the moving speed of the carriage, thereby increasing the frequency of flushing operation. Thus, the reliability of printing operation is ensured. When the travel time period of the carriage is short, the reference value is increased, thus decreasing the frequency of flushing operation. Accordingly, throughput of the recording apparatus can be improved.

DETAILED DESCRIPTION OF THE PREFERRED EMBODIMENTS

Figure 1:
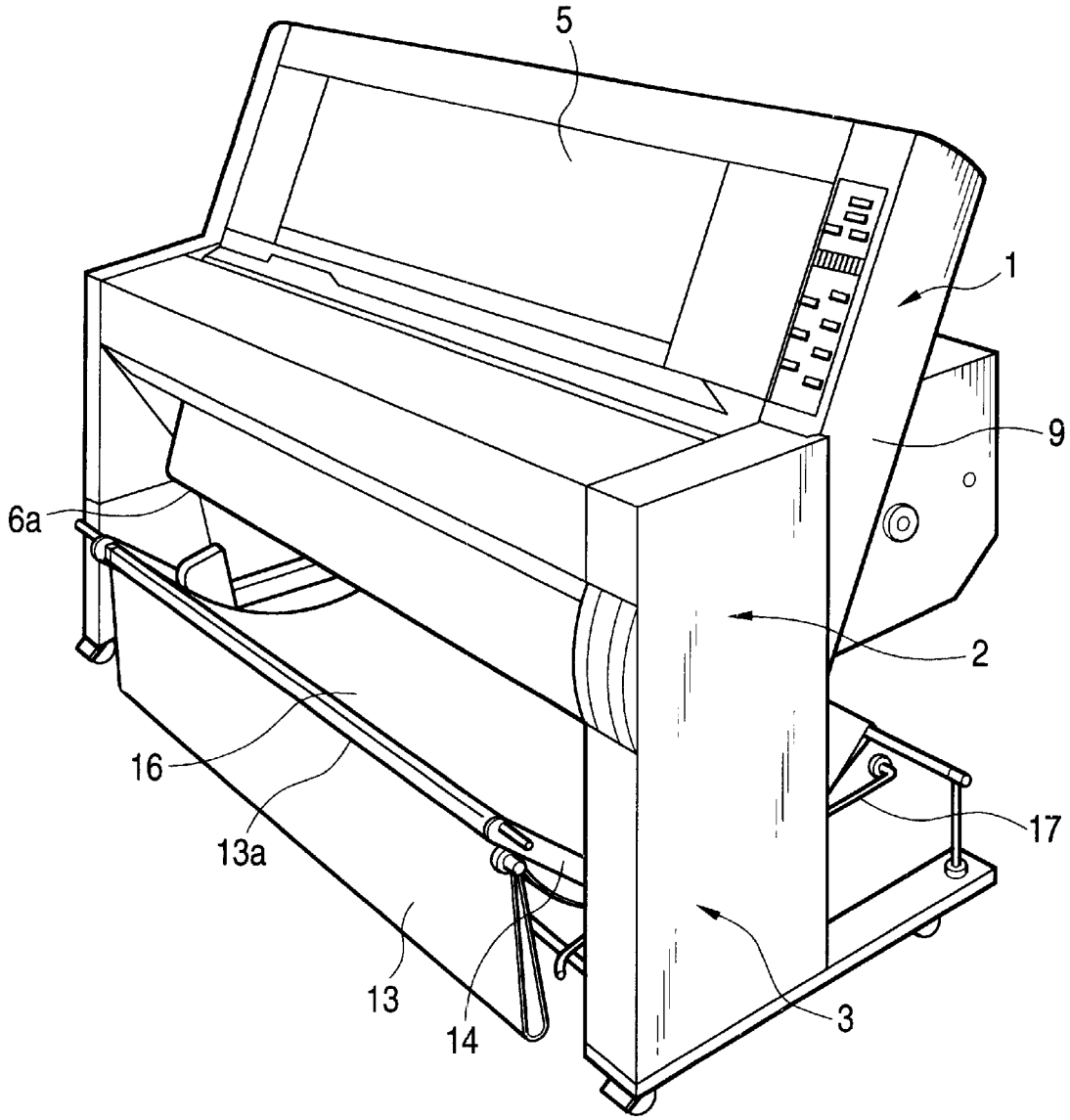
FIG. 1 is a perspective view showing the appearance of an ink-jet recording apparatus to which the present invention is applied.
Figure 2:
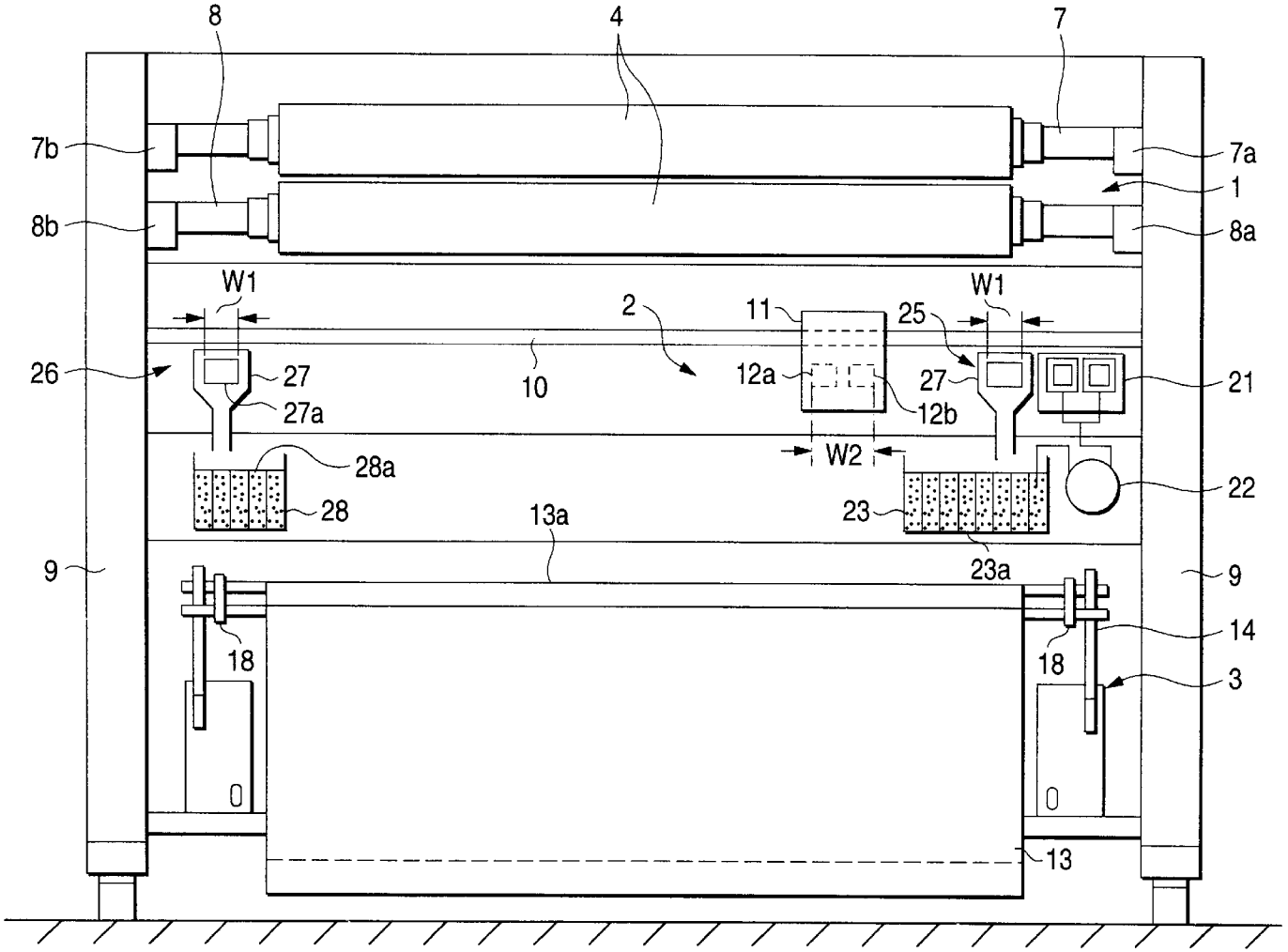
FIG. 2 is a front view showing the internal configuration of the apparatus.
Figure 3:
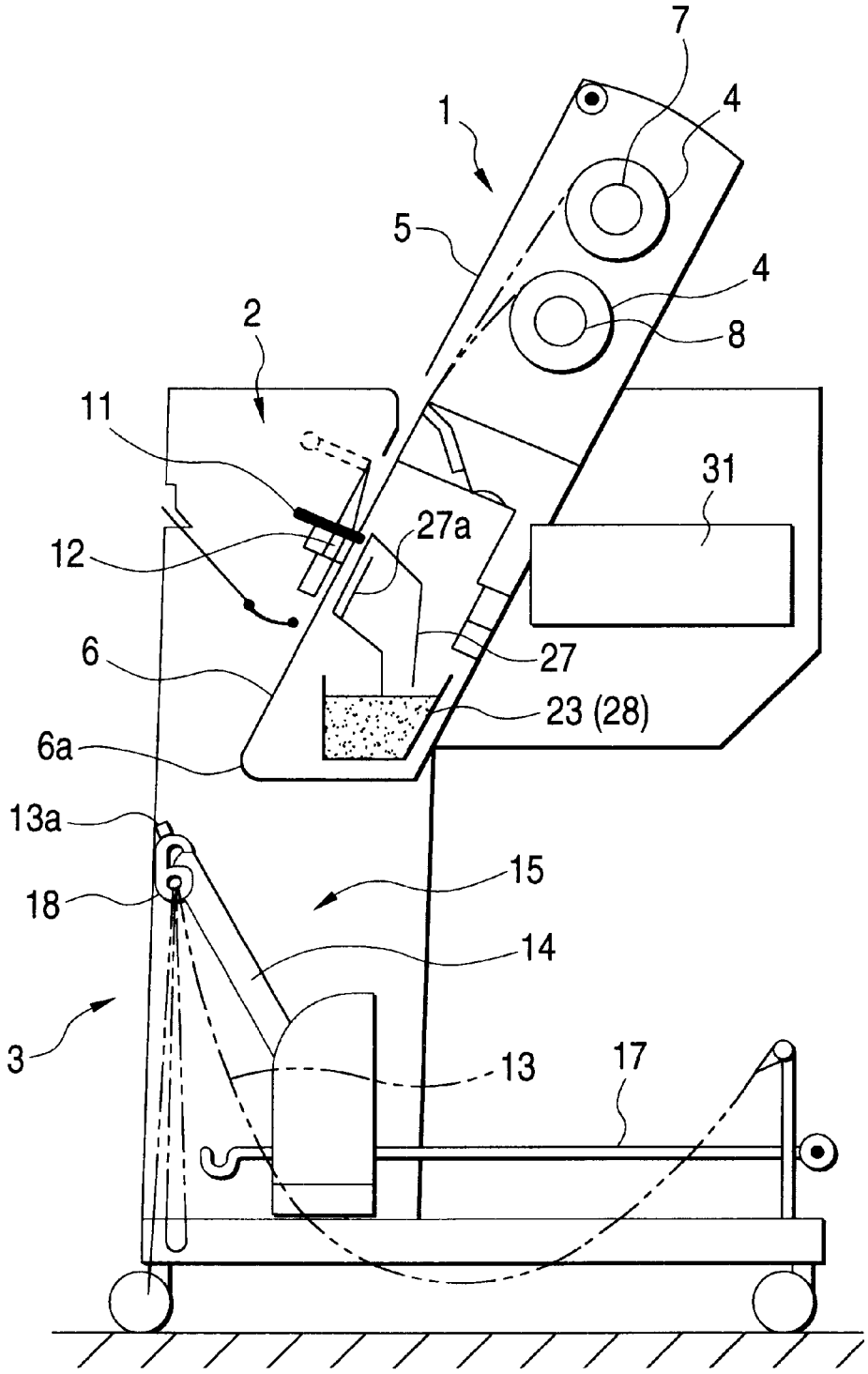
FIG. 3 is a vertical section view at a flushing region of the apparatus of FIG. 2.

The present invention will now be described with reference to an embodiment of an ink-jet recording apparatus to which the present invention is applied. FIGS. 1 through 3 show the configuration of a large-sized ink-jet recording apparatus (hereinafter referred to also as a "printer") to be installed directly on a floor. FIG. 1 is a perspective view of the printer; FIG. 2 is a front view showing the internal configuration of the printer; and FIG. 3 shows a vertical section view at a flushing region to be described later with reference to FIG. 2.

In this printer, a paper supply section 1 is located above a print section 2, and a paper output section 3 is located below the print section 2. A paper transporting path is formed into a substantially linear path which is tilted relative to the vertical line and extends from the paper supply section 1 to the paper output section 3 by way of the print section 2. As shown in FIGS. 2 and 3, long roll sheet 4 having a width of up to 44 inches can be loaded on the paper supply section 1 as a recording medium. At the time of replacement, the roll sheet 4 can be removed. The position where the paper supply section 1 is set is optimal for the operator replacing the roll sheet 4 with new roll sheet while remaining in a standing position.

As shown in FIGS. 1 and 3, the front surface of the roll sheet 4 loaded on the paper supply section 1 can be covered with a roll sheet cover 5. When the roll sheet cover 5 is in a closed position, the upper surface of the roll sheet cover 5, the print section 2, and a paper delivery section 6 are substantially brought into alignment, thus enabling supply or discharge of paper, such as a cut sheet, of a type other than the roll sheet 4.

As shown in FIG. 2, a pair of spindle receivers 8*a*, 8*b* are disposed below another pair of spindle receivers 7*a*, 7*b*. The spindle receiver pairs 7 and 8 are mounted on a pair of frames 9 of the printer main unit. The spindle 7 having the long roll sheet 4 fitted thereon is supported by the spindle receivers 7*a* and 7*b*, and the spindle 8 having the long roll sheet 4 fitted thereon is supported by the spindle receivers 8*a* and 8*b*.

As can be seen from FIGS. 2 and 3, the upper spindle 7 and the lower spindle 8 are aligned so as to be parallel and to assume a diagonal relationship; specifically, the lower spindle 8 is located closer to the operator than the upper spindle 7. The respective sheets of roll sheet 4 are transported along the paper transporting path, which is formed substantially linearly and inclined toward the entrance of the paper output section 3 by way of the print section 2.

As shown in FIG. 2, a guide rod 10 is provided in the print section 2 and is horizontally attached to the frames 9, 9. A carriage 11 is provided on the guide rod 10 so as to travel back and forth along the same. A first recording head 12*a* and a second recording head 12*b* are mounted side-by-side on the carriage 11 with respect to the traveling direction of the carriage 11. The paper delivery section 6 is formed below the area scanned by the recording heads 12*a* and 12*b*, so as to constitute a portion of the paper transporting path.

The paper output section 3 receives printed paper and comprises a catch cloth 13 whose paper-receiving surface is formed from a collapsible canvas sheet. As shown in FIG. 3, the paper output section 3 is switched by a paper delivery changeover lever 14 so as to guide printed paper to a first receiving section 15 located substantially immediately below the print section 2 or so as to guide printed paper to an unillustrated second receiving section which is temporarily formed in the vicinity of the front side of the printer by expansion of the catch cloth 13 over the floor in front of the printer main unit.

In a case where printed paper is guided to the first receiving section 15, an opening 16 is formed between a rear edge 6*a* of the paper delivery guide 6 situated at a position lower than the print section 2 and an upper edge 13*a* of the catch cloth 13 protruding into the paper transporting path, by means of the paper delivery changeover lever 14.

In a case where printed paper is guided to the second receiving section, the upper edge 13*a* of the catch cloth 13 is retracted backward relative to the paper transporting path, by means of the paper delivery changeover lever 14. A catch cloth fixing lever 17 is withdrawn from the front side of the printer, and a hook 18 on which the front end of the catch cloth 13 is fixed is engaged with the front end of the fixing lever 17, whereby the catch cloth 13 can be spread to extend forward of the front side of the printer main unit.

As shown in FIG. 2, one end of the area over which the recording heads 12*a* and 12*b* mounted on the carriage 11 travel corresponds to a non-print region (the home position), where a capping unit 21 is disposed. The recording heads 12*a* and 12*b* are mounted on the carriage 11 such that nozzle formation planes of the recording heads 12*a* and 12*b* are slightly tilted relative to the perpendicular. The capping unit 21 comprises two cap members which are arranged so as to correspond to and to seal the respective nozzle forming surfaces of the recording heads 12*a* and 12*b* when the recording heads 12*a* and 12*b* move to the home position. A suction pump 22 for imparting negative pressure to the interior space of the cap members is provided below the capping unit 21.

The capping unit 21 acts as a closure member for preventing drying of the nozzle orifices of the recording heads 12*a* and 12*b* while the printer is in an idle mode. Further, the capping unit 21 acts as head cleaning means for sucking ink by imparting negative pressure generated by the suction pump 22 to the recording heads 12*a* and 12*b*. The waste ink evacuated by the suction pump 22 is delivered to a first waste ink tank 23 and is absorbed by a waste-fluid absorbing material 23*a* housed in the tank 23.

A first flushing region 25 is formed on the path over which the recording heads 12*a* and 12*b* travel, so as to become adjacent to the capping unit 21. An ink receiver unit (hereinafter referred to also as a "flushing box") 27 is disposed in the first flushing region 25. The waste ink collected by the ink receiver unit 27 is delivered to the first waste ink tank 23 and is absorbed by the waste-fluid absorbing material 23*a* housed in the tank 23.

A second flushing region 26 is formed in the vicinity of the end of the center print area opposite the end on which the capping unit 21 is situated. The ink receiver 27 is provided even in this second flushing region 26, and the waste ink collected by the ink receiver 27 is delivered to a second waste-fluid tank 28, where the waste ink is absorbed by a waste-fluid absorbing material 28*a* housed in the tank 28.

A porous sheet 27*a* is provided within an opening formed in the respective ink receiver unit 27 (the ink receiver units 27 situated at flushing positions). The porous sheet 27*a* receives ink droplets resulting from flushing of the recording heads 12*a* and 12*b* and introduces the ink droplets into a housing constituting the ink receiver unit 27, wherein the wasted ink is absorbed by the waste fluid absorbing material 23*a* or 28*a*.

The ink receiver units 27 disposed in the flushing regions have substantially the same configuration. The width W1 of the ink receiver unit 27 is smaller than the total width W2 of the first and second recording heads 12*a* and 12*b*, with respect to the traveling direction of the carriage 11. More specifically, the width W1 of the ink receiver unit 27 is slightly greater than the respective widths of the first and second recording heads 12*a* and 12*b*.

While the carriage 11 is in an accelerated traveling state, the recording heads 12*a* and 12*b* are controlled so as to be flushed at respective predetermined timings. Even in spite of a width relationship between the recording heads 12*a* and 12*b* and the ink receiver unit 27, the recording heads 12*a* and 12*b* are controlled so that the ink droplets sprayed during flushing operation can be collected without fail within the respective flushing positions constituted by the ink receiver units 27.

As will be described later, flushing sequences which are to selectively used, as needed, according to the width of paper on which images are to be printed are introduced for the first and second flushing regions, thus ensuring the reliability of printing operation by means of performing flushing operation without deteriorating throughput.

As shown in FIG. 3, cartridge holders 31 for retaining ink cartridges are provided at opposite ends of and behind the print section 2 of the printer. Each ink cartridge holder 31 is configured so as to pivot through about 45 degrees between a cartridge exchange mode and an ink supply mode. In the cartridge exchange mode, the ink cartridge holder 31 is tilted from its longitudinal direction at an angle of 45 degrees, to thereby enable the operator to exchange ink cartridges. In the ink supply mode, the ink cartridge holder 31 is in a horizontal position, and ink is supplied to the recording heads.

Figure 4:
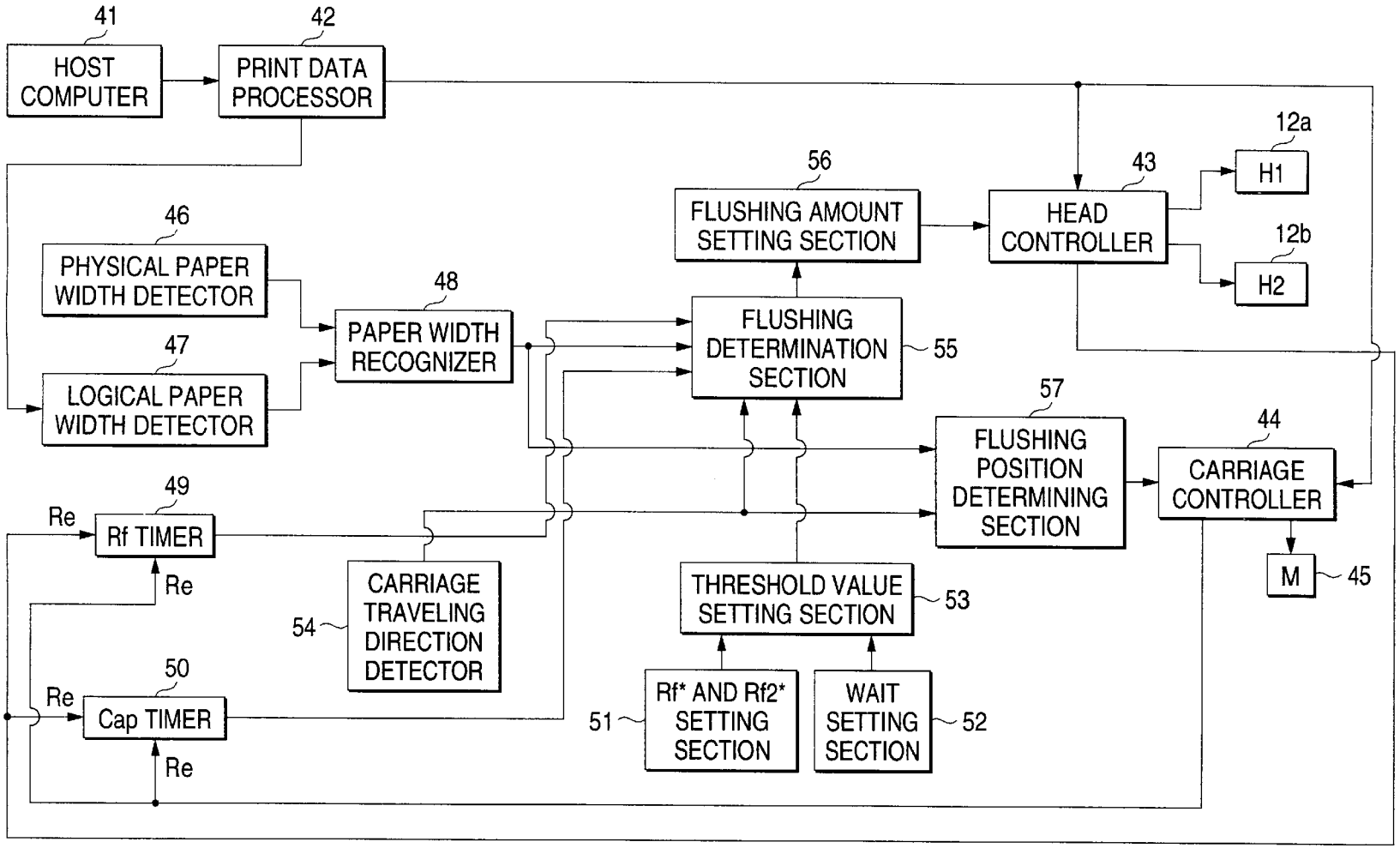
FIG. 4 is a block diagram showing the basic configuration of a flushing controller according to the present invention.

FIG. 4 is a block diagram primarily showing the configuration of a flushing controller provided on the printer. In FIG. 4, a host computer 41 having a built-in printer driver supplies an instruction signal to a print data processor 42. The instruction signal issued by the print data processor 42 is supplied to a head controller 43. The head controller 43 supplies head drive signals based on bit map data to the respective first and second recording heads 12*a* and 12*b*. Simultaneously, a carriage controller 44, which has received an instruction signal from the print data processor 42, activates a carriage motor 45. Accordingly, the first and second recording heads 12*a* and 12*b* print images on the recording paper.

The printer is equipped with a physical paper width detector 46. The width of recording paper can be physically detected by means of, e.g., a photosensor (not shown), provided on the carriage 11. Further, the printer is equipped with a logical paper width detector 47, which uses paper data which the user has entered in the printer driver of the host computer 41.

Further, the printer is equipped with a paper width recognizer 48 which recognizes the width of paper used for flushing control, through use of data sets output from the physical paper width detector 46 and the logical paper width detector 47. If the paper data output from the logical paper width detector 47 are not available, the paper width recognizer 48 considers the paper data to correspond to the maximum paper width. After the paper data output from the physical paper width detector 46 and the paper data corresponding to the maximum paper width are compared, the smaller paper width is considered to be a paper width.

In a case where print data are small and correspond to the width of A4-size paper while the physical paper width detector 46 has recognized A0 size, the logical paper width detector 47 detects that A4-size paper is loaded. Hence, the paper width recognizer 48 recognizes that A4-size paper is set while the home-position-side of the paper is taken as a reference position.

The printer is equipped with an Rf timer (refresh timer) 49 and a Cap timer 50. The Rf timer 49 starts counting a time elapsed from completion of the previous flushing operation or from release of the recording heads 12*a* and 12*b* from the capping unit. At the time of the next flushing operation, the Rf timer 49 receives a reset signal Re from the head controller 43 or the carriage controller 44, thereby clearing time count data.

The Cap timer 50 starts counting a time elapsed from completion of printing of single pass and is reset when the recording heads 12*a* and 12*b* are capped by the capping unit or by means of a print activation trigger signal. Like the Rf timer 49, the Cap timer 50 resets time count data upon receipt of the reset signal Re from the head controller 43 or the carriage controller 44.

Further, the printer is equipped with setting section 51 capable of setting a refresh time Rf* and a refresh time Rf2*. The refresh time Rf* and the refresh time Rf2* are utilized by threshold value setting section 53. According to the direction in which the carriage 11 starts traveling, the refresh time Rf* and the refresh time Rf2* are compared with the time counted by the Rf timer 49, to thereby produce a threshold value used for determining whether flushing operation is to be performed.

Further, the printer is equipped with an WAIT setting section 52. For example, when the user uses paper on which ink is hard to be dried, the user enters a path desiccation time (WAIT) by way of a control panel. The path desiccation time (WAIT) to be used for delaying starting of scanning operation of the carriage 11 is acquired for each printing of single pass. The path desiccation time is also compared with the time counted by the Rf timer 49, to thereby produce a threshold value used for determining whether flushing operation is to be performed. In this case, the refresh time Rf* and the refresh time Rf2* may be stored in memory beforehand.

The printer is equipped with carriage (CR) traveling direction detector 54 which supplies to flushing determination section 55 data pertaining to whether the carriage 11 starts traveling from the home position or starts traveling from the position opposite the home position.

Detailed operation of flushing determination section 55 will be described later. Through utilization of the paper width data output from the paper width recognizer 48, data output from the CR traveling direction detector 54, and respective threshold value data sets set by threshold value setting section 53, flushing determination section 55 determines whether flushing operation is to be performed, by means of primarily determination between the time count data output from the Rf timer 49 and the foregoing data sets.

An instruction signal produced by the flushing determination section 55 is supplied to a flushing amount setting section 56. Data pertaining to the number of ink droplets to be ejected set by the flushing amount setting section 56 are supplied to the head controller 43. The respective recording heads 12*a* and 12*b* eject a predetermined number of ink droplets through flushing operation.

The data output from the CR traveling direction detector 54 and the data output from the paper width recognizer 48 are supplied to the flushing position determining section 57. According to the traveling state of the carriage 11 and the paper width, a determination is made as to whether the recording heads 12*a* and 12*b* are to be subjected to flushing in the first flushing region or the second flushing region. More specifically, according to the traveling state of the carriage 11 and the paper width, a determination is made as to which of the first flushing region and the second flushing region the carriage 11 can reach immediately. Thus, there is determined a flushing region where the carriage 11 can immediately reach. The instruction signal determined by the flushing position determining section 57 is supplied to the carriage controller 44, thereby activating the carriage motor 45 such that the carriage 11 moves to either the first or second flushing region.

Figure 5:
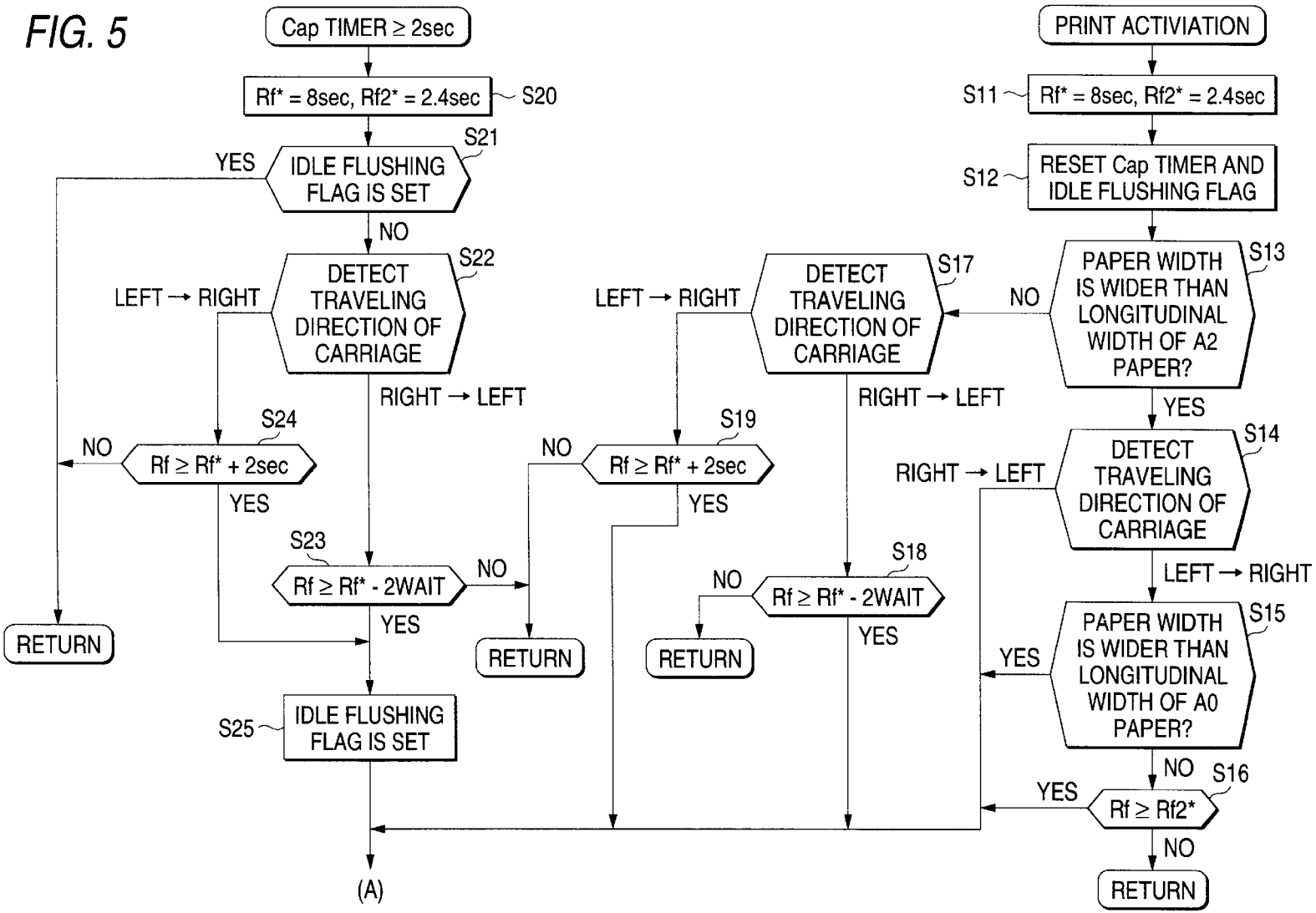
FIG. 5 is a flowchart for describing the operation of the flushing controller shown in FIG. 4, according to one embodiment of the invention.
Figure 6:
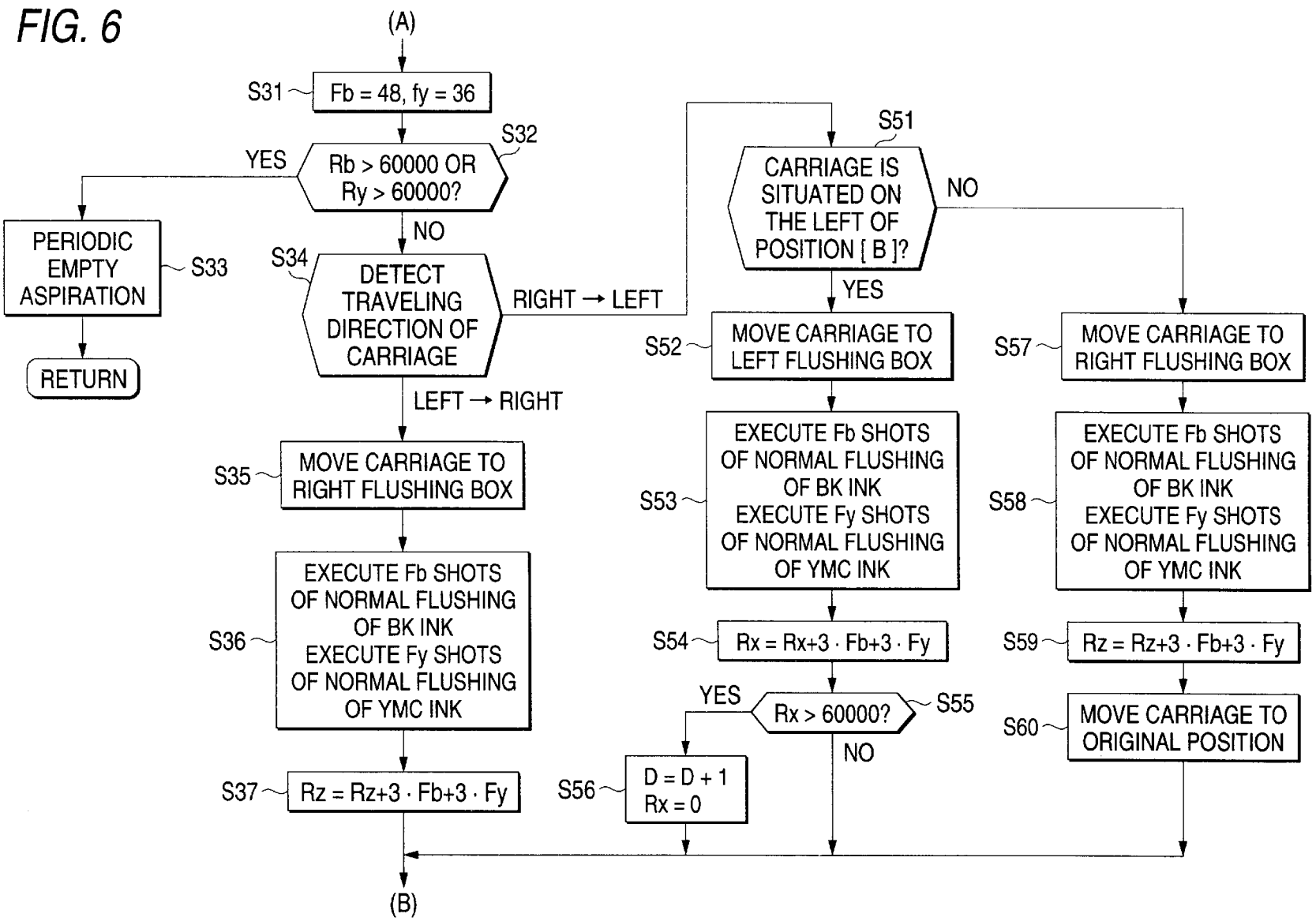
FIG. 6 is a flowchart for describing the operation of the flushing controller following the operation shown in FIG. 5.
Figure 7:
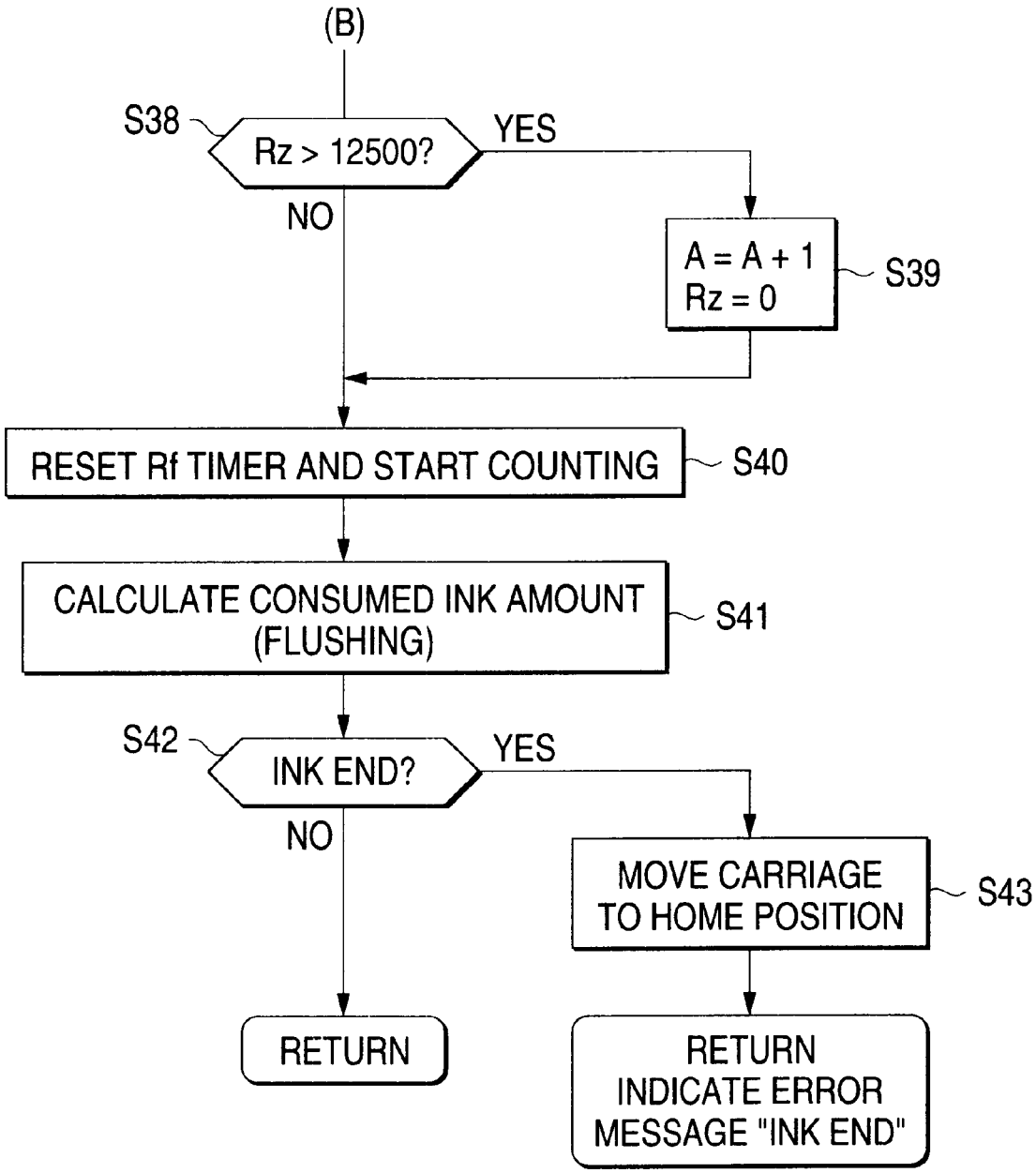
FIG. 7 is a flowchart for describing the operation of the flushing controller following the operation shown in FIG. 6.

FIGS. 5 through 7 are flowcharts for describing determination as to whether or not the flushing controller must perform flushing operation, as well as how to proceed the flushing operation when the flushing controller is determined to perform the same. FIG. 5 shows steps for determining whether flushing operation is to be periodically performed according to conditions; i.e., the width of paper on which images are to be printed and the traveling direction of the carriage 11.

As shown in FIG. 5, a determination as to whether flushing operation is to be performed is implemented by a routine which is to be triggered when a print start instruction is received. In step S11 of the routine, the Rf* and Rf2* setting section 51 sets "Rf*=8 sec." and "Rf2*=2.4 sec." Subsequently, in step S12, the Cap timer 50 is reset, and a flag for directing flushing operation when the printer is in an idle state (hereinafter referred to simple as an "idle flushing flag"), which will be described later, is reset.

In step S13, the paper width is recognized. Data pertaining to the physical paper width or the logical paper width, whichever is determined to be smaller by the paper width recognizer 48, are adopted as the paper width. If in step S13 the paper width is determined to be greater than the length of A2-size paper (i.e., when YES is selected), processing proceeds to step S14, where a determination is made as to whether flushing operation is to be performed, according to the traveling direction of the carriage 11.

If, from the data output from the CR traveling direction detector 54, it is found that the carriage 11 starts traveling from right to left; i.e., from the home position, processing proceeds to a flushing process to be described later, by way of (A) shown in FIG. 5. Further, when the carriage 11 starts traveling from left to right, in step S15 a determination is made as to the size of paper, i.e., whether or not the paper width is greater than the length of A0-size paper. If the paper width is determined to be greater than the length of A0-size paper (i.e., when YES is selected), paper of the maximum size is determined to be used. In this case, processing proceeds to the flushing step by way of (A) shown in FIG. 5.

In contrast, if in step S15 the paper width is determined not to be greater than the length of A0-size paper (i.e., when NO is selected), flushing operation is not performed in principle. However, if at least a predetermined period of time has already elapsed from the previous flushing operation, flushing operation is performed. This corresponds to processing relating to step S16. A determination is made as to whether or not the elapsed time counted by the Rf timer 49 has reached or exceeded a predetermined period of time (RF2*=2.4 sec.).

"RF2*=2.4 sec." corresponds to a period of time required to print substantially single pass over the maximum paper width (44 inches in the embodiment). If the elapsed time counted by the Rf timer 49 reaches or exceeds Rf2*=2.4 sec., the period of time equal to the time required for printing single pass over the maximum paper width has already elapsed. Therefore, the recording heads 12*a* and 12*b* must be subjected to flushing. Occurrence of such a phenomenon is considered to be ascribable to temporal suspension of printing operation for reasons of a long period of processing time being required by the host or a long period of time being required for transporting data from the host to the printer.

If, for these reasons, a determination is made as to whether or not the elapsed time counted by the Rf timer 49 has reached or exceeded the predetermined period of time (Rf2) (i.e., when YES is selected), flushing operation is determined to be performed. If the elapsed time has not reached the predetermined time (i.e., when NO is selected), processing proceeds to an idle state of the printer or the next processing of the CPU by way of RETURN shown in FIG. 5.

If in step S13 the paper width is determined not to be greater than the length of A2-size paper (i.e., when NO is selected), processing proceeds to step S17, where a determination is made as to whether flushing operation is to be performed, according to the direction in which the carriage 11 attempts to travel. If in step S17 it is found, from the data output from the CR traveling direction detector 54, that the carriage 11 travels from right to left in the next printing operation, in step S18 the threshold value of "Rf*−2WAIT" is compared with the elapsed time counted by the Rf timer 49.

The threshold value setting section 53 produces the threshold value from the data output from the setting section 51 and 52, and the flushing determination section 55 compares the threshold value with the elapsed time counted by the Rf timer 49. In the present embodiment, in step S11 the "Rf*" is set to 8 sec., and the time relating to "WAIT" corresponds to the path desiccation time set by the WAIT setting section 52.

If in step S18 the elapsed time counted by the Rf timer 49 is determined to have reached or exceeded the threshold value (i.e., when YES is selected), flushing is effected by way of (A) shown in FIG. 5. In contrast, if the elapsed time counted by the Rf timer 49 is determined not to have reached the threshold value (i.e., when NO is selected), processing proceeds to RETURN.

Further, if in step S17 it is found from the data output from the CR traveling direction detector 54 that the carriage 11 is to attempt to travel from left to right in the next printing operation, in step S19 the threshold value of "Rf*+2 sec." is compared with the elapsed time counted by the Rf timer 49. If in step S19 the elapsed time counted by the Rf timer 49 is determined to have reached or exceeded the threshold value (i.e., when YES is selected), flushing operation is performed by way of (A) shown in FIG. 5. Further, if the elapsed time counted by the Rf timer 49 is determined not to have reached the threshold value (i.e., when NO is selected), processing proceeds to RETURN.

As can be seen from results of the comparison performed in steps 18 and S19, the threshold value used for comparison when the carriage 11 is to travel from right to left in the next printing operation is set so as to be greater than the threshold value used for comparison when the carriage 11 is to travel from left to right in the next printing operation. In other words, the probability of the recording heads 12*a* and 12*bb* being subjected to flushing within the right-hand flushing region (close to the home position) is made higher than the probability of the recording heads 12*a* and 12*b* being subjected to flushing within the left-hand flushing region, thus improving throughput of the printer.

Figure 8:
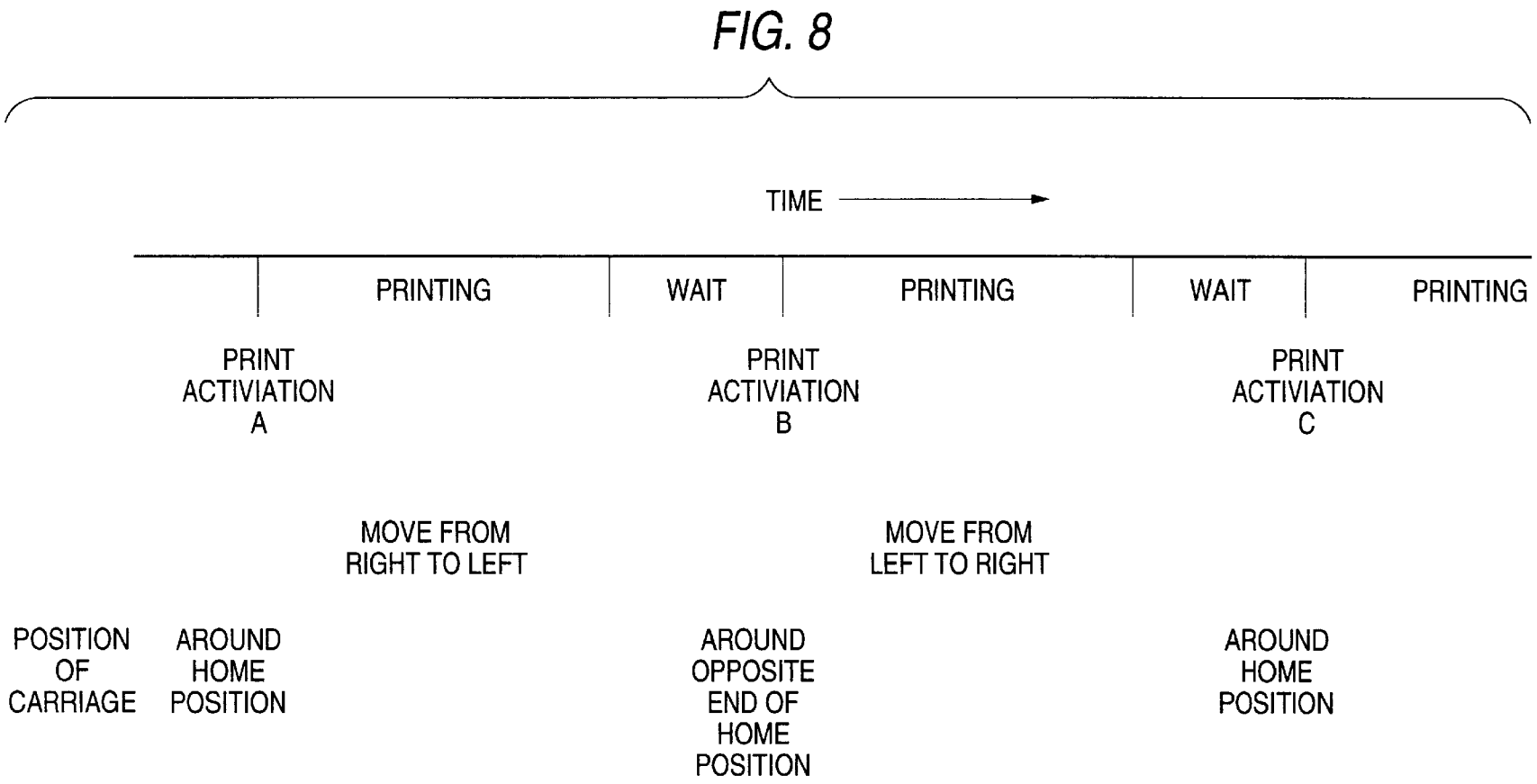
FIG. 8 is an illustration for describing the operation of a carriage with regard to the setting of a threshold value to be used by the flushing controller shown in FIG. 4.

FIG. 8 shows a theory for determination of respective threshold values. FIG. 8 shows two traveling modes of the carriage 11; a mode in which the carriage 11 travels from right to left, i.e., from the area in the vicinity of the home position to the direction opposite thereto, when a print activation A is received; and a mode in which the carriage travels from left to right, i.e., from the area in the vicinity of the end opposite the home position to the area in the vicinity of the home position, when a print activation B is received.

In order to increase the probability of the recording heads being subjected to flushing in the right-hand flushing region (in the vicinity of the home position), the assumption should be made that the elapsed time counted by the Rf counter 49 barely avoids reaching the threshold value at the time of the print activation A and no flushing is performed. In order to prevent flushing operation from being performed in response to the print activation B, the threshold value used for determination relating to the print activation B must be greater than that used in relation to the print activation A by merely an amount corresponding to "printing time+WAIT."

"2 sec." of "Rf*+2 sec." shown in step S19 corresponds to the sum of a margin and the maximum time required for printing single pass over the paper (whose width is less than the length of A2-size paper). Specifically, "2 sec." corresponds to the sum of "α+ the time required to print single pass on the maximum paper whose width is equal to the length of A2-size paper."

"2WAIT" of "Rf*−2WAIT" shown in step S18 corresponds to a doubled margin. The variable must be decreased from the threshold value used when the carriage 11 travels from the home position, because if the variable is added to the threshold value used when the carriage 11 travels from the position opposite to the home position, the total amount of time exceeds the time required for subjecting the recording heads 12*a* and 12*b* to flushing, thus clogging the recording heads.

[A0069]

Turning again to FIG. 5, another factor used for determining whether flushing operation is to be performed is a routine which is started when the Cap timer 50 is activated. Specifically, in the present embodiment, when the elapsed time counted by the Cap timer 50 is equal to or greater than two seconds, the routine is activated. In step S20 of the routine, "RF*=8 sec." and "Rf2*=2.4 sec." are set, as in the case of processing relating to step S11. Subsequently, in step S21 a determination is made as to whether or not the idle flushing flag has been set.

If the idle flushing flag is determined to have been set (i.e., when YES is selected), processing proceeds to RETURN. If the idle flushing flag is determined not to have been set (i.e., when NO is selected), processing proceeds to step S22. Steps S22, S23, and S24 correspond to steps S17, S18, and S19, and determinations are made in the same manner as mentioned previously. In other words, if the elapsed time counted by the Rf timer 49 is determined to have reached or exceeded the threshold value in step S23 or S24, the idle flushing flag is set in step S25, and processing proceeds to the flushing step by way of (A) shown in FIG. 5.

Since in step S25 the idle flushing flag is set, processing proceeds to RETURN in step S21 even when the Cap timer 50 is activated. Since the Cap timer 50 is not reset by the flushing operation, the foregoing means is employed. This is because if the elapsed time counted by the Cap timer 50 reaches or exceeds a certain value (3 sec. when no print data are available and 20 sec. when print data are available), the recording heads are capped in order to prevent drying of the ink remaining in the nozzles. Such an operation is used for another routine.

FIGS. 6 and 7 show a routine relating to the flushing operation following the processing shown in FIG. 5. In step S31 following (A) shown in FIG. 6, the number of flushing shots is set by the flushing amount setting section 56 shown in FIG. 4. In the present embodiment, as described by "Fb=48, Fy=36," the number of flushing shots to be performed by the first recording head 12*a*, which works with black ink, cyan ink, and magenta ink, is set to 48; and the number of flushing shots to be performed by the second recording head 12*b* which works with yellow ink, light cyan ink, and light magenta ink, is set to 36.

In step S32, a determination is made as to whether or not the number of ink droplets ejected into the two cap members provided in the capping unit 21 has reached or exceeded a predetermined number. If it is determined that the number of ink droplets ejected by either of the two cap members has reached or exceeded 60,000 shots, periodic aspirating operation is performed without flushing operation being performed. As a result, the ink remaining in the cap members is evacuated by the suction pump 22, and the thus-evacuated ink is absorbed by the waste ink tank 23. Simultaneously, the counter, which counts the number of ink droplets ejected in the two cap members, is reset.

In step S33, if the number of ink droplets ejected is determined not to have reached or exceeded a predetermined number, in step S34 a determination is made as to the direction in which the carriage 11 is to travel in the next printing operation. In a case where the carriage 11 is to travel from right to left, in step S35 the recording heads 12*a* and 12*b* are subjected to flushing within the right-hand flushing box 27. In this case, as shown in step S36, the first recording head 12*a* is subjected to the number of flushing actions (Fb) set in step S31, and the second recording head 12*b* is subjected to the number of flushing actions (Fy) set in step S31. In step S37 the number of ink droplets ejected during flushing within the right-hand flushing box 27 is counted.

In step S38 shown in FIG. 7, a determination is made as to whether or not the number of ink droplets ejected during flushing within the right-hand flushing box 27 has reached or exceeded a predetermined number. If the number of ink droplets is determined to have reached or exceeded 12,500 shots, in step S39 a value "1" is added to number "A" counted by the first waste fluid box 23 and the number of ink droplets ejected during flushing within the right-hand flushing box 27 is reset. In step S40 the count value of the Rf timer 49 is reset, and the Rf timer 49 starts counting immediately after being reset.

Processing then proceeds to step S41, where ink is detected. In this step, the amount of ink consumed in the ink cartridge is calculated from the number of ink droplets ejected, and the thus-calculated amount of ink consumed is retained. In step S42 a determination is made as to whether or not the amount of ink consumed has reached a specified value. If the amount of ink consumed is determined not to have reached the specified value, processing proceeds to RETURN. In contrast, if the amount of ink consumed is determined to have reached the specified value, processing proceeds to step S43, where the carriage 11 returns to the home position. The recording heads 12*a* and 12*b* are sealed by the capping unit, and an error message (Ink End) is indicated on a display.

[A0077]

Turning again to FIG. 6, in a case where in step S34 the carriage 11 is determined to travel from left to right in the next printing operation, in step S51 a determination is made as to whether or not the carriage 11 is situated on the left with reference to [B]. [B] represents a position where a determination is made as to which of the two flushing boxes 27 the carriage 11 can reach within a shorter period of time. When YES is selected in step S51, processing proceeds to step S52, where the recording heads 12*a* and 12*b* are subjected to flushing within the left flushing box 27.

Processing proceeds to step S53, where the first recording head 12*a* is subjected to the number of flushing operations (Fb) set in step S31, and the second recording head 12*b* is subjected to the number of flushing operations (Fy) set in step S31. In step S54 the number of ink droplets ejected within the left flushing box 27 is counted.

In step S55, a determination is made as to whether or not the number of ink droplets ejected during flushing within the left flushing box 27 has reached or exceeded a predetermined number. When the number of ink droplets is determined to have reached or exceeded 60,000 shots, in step S56 a value "1" is added to count value "D" of the second waste fluid box 28, and the count value relating to the number of ink droplets ejected during flushing within the left flushing box 27 is reset. Processing then proceeds to step S38 shown in FIG. 7.

When NO is selected in step S51, processing proceeds to step S57, where the recording heads 12*a* and 12*b* are subjected to flushing within the right flushing box 27. Processing proceeds to step S58, where the first recording head 12*a* is subjected to the number of flushing operations (Fb) set in step S31, and the second recording head 12*b* is subjected to the number of flushing operations (Fy) set in step S31. In step S59 the number of ink droplets ejected within the right flushing box 27 is counted. Subsequently, processing proceeds to step S60, and there is performed an operation for returning the carriage 11 to its original position where the printing operation is interrupted. Subsequently, processing proceeds to step S38 shown in FIG. 7.

In the flowchart shown in FIG. 5, a determination as to paper width is made twice. Paper widths are divided into a total of three size categories, and for each of the three categories a determination is made as to whether to perform flushing operation is to be performed. The categories may be changed within the range of paper width which the printer works with, as needed.

Next, an ink jet recording apparatus according to anther embodiment of the invention will be described below. The elements as same as the previous embodiment are designated by the same reference numerals, and detailed explanations are omitted.

In this embodiment, a setting section 51 is constituted of, e.g., a data storage and stores numerical values which are shown in Table 1 and are linked to a paper width and a print mode; that is, a carriage travel speed V.

As shown in Table 1, a refresh time Rf is classified into two modes; namely, a high-quality print mode and a draft-quality print mode. In the high-quality print mode, the carriage 11 travels at a speed of, e.g., 200 cps. In the draft-quality print mode, the carriage 11 travels at a speed of, e.g., 300 cps. Reference values Rf* are specified for each paper width W in connection with both the high-quality print mode and the draft-quality print mode.

The reference values Rf* are set to a difference between the longest flushing cycle T (12.4 sec. in the present embodiment) and a travel time Ct required by the carriage 11 for effecting printing operation for one path; that is, (T−Ct). The reference value Rf* is utilized by the threshold value setting section 53. When a command for printing activation is issued or when the Cap timer 50 has counted two seconds or more, the threshold value setting section 53 uses the reference value Rf* in preparing a threshold value for determining whether or not flushing operation is to be performed.

TABLE 1

| paper width | V = 200 (cps) | | V = 300 (cps) | |
|---|---|---|---|---|
| W (mm) | Rf* (sec) | Ct (sec) | Rf* (sec) | Ct (sec) |
| 1040 ≧ W > 600 | 10.4 | 2.0 | 11.0 | 1.4 |
| 600 ≧ W > 520 | 11.2 | 1.2 | 11.6 | 0.8 |
| 520 ≧ W > 300 | 11.4 | 1.0 | 11.7 | 0.7 |
| 300 ≧ W > 210 | 11.8 | 0.6 | 12.0 | 0.4 |
| 210 ≧ W > 150 | 12.0 | 0.4 | 12.1 | 0.3 |
| 150 ≧ W | 12.1 | 0.3 | 12.2 | 0.2 |

In the present embodiment, the WAIT setting section 52 acquires about two seconds as the WAIT parameter every time one path is printed. A threshold value having the path dry time added thereto is compared with the time counted by the Rf timer 49, thereby rendering a determination as to whether or not flushing operation is to be effected.

Figure 9:
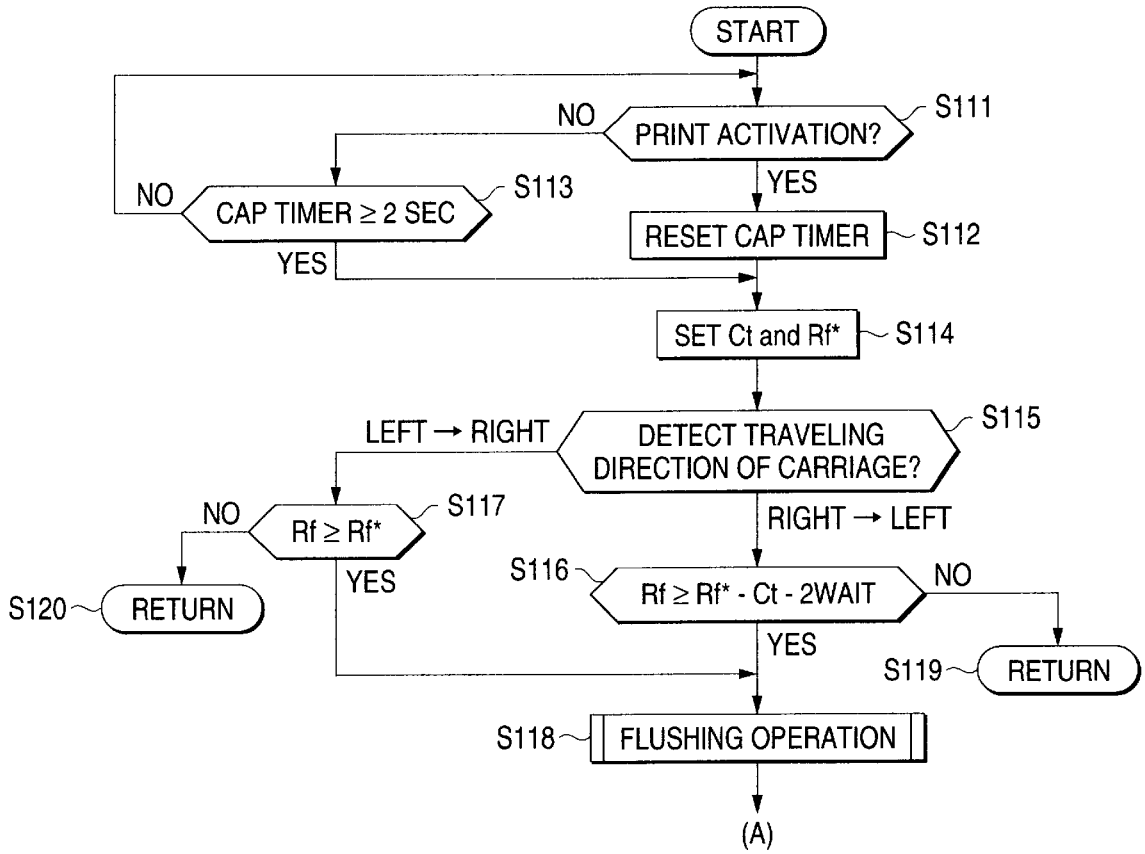
FIG. 9 is a flow chart for describing the operation of the flushing controller shown in FIG. 4, according to another embodiment of the invention.

An operation for determining whether or not the recording apparatus having the foregoing construction performs a flushing operation is described in accordance with the flowchart shown in FIG. 9.

When a print activation instruction is received (step S111), the Rf timer 49 is reset (step S112). Alternatively, when the Rf timer 49 has counted a predetermined period of time or more: e.g., two seconds or more (step S113), setting section 51 selects a carriage travel time Ct and a reference value Rf* in accordance with the paper width W output from the paper width recognizer 48 and the carriage travel speed V corresponding to the print mode (step S114). There is prepared an operation for determining whether or not a flushing operation is necessary.

In other words, printing operation is not yet commenced when the Rf timer 49 has counted two seconds. This is because the recording heads 12*a* and 12*b* are exposed from the capping unit 21 and are left while no ink droplets are ejected under a condition where print data is not successfully supplied, failures to eject ink droplets are likely to arise. For this reason, when a period of about parameter WAIT or two seconds (in the present embodiment) have elapsed, there is prepared a determination as to whether or not flushing operation is effected. When the recording heads 12*a* and 12*b* are exposed from the capping unit 21 and when squirting of no ink droplets has elapsed five seconds, the recording heads 12*a* and 12*b* are sealed with the capping unit 21.

Subsequently, a determination is made as to a possible direction in which the carriage 11 is about to move, on the basis of the data output from the carriage traveling direction detector 54 (step S115). When the carriage 11 is about to move from right to left; that is, when the carriage 11 is about to move from the home position, the threshold value setting section 53 sets a threshold value defined by Rf*−Ct−2WAIT. Further, the flushing determination section 55 compares the threshold value "Rf*−Ct−2WAIT" with the time Rf counted by the Rf timer 49 (step S116).

When the carriage 11 moves from left to right, the threshold value setting section 53 sets a threshold value defined by "Rf*." Further, the flushing determination section 55 compares the threshold value "Rf*" with the time Rf counted by the Rf timer 49 (step S117).

In either step S116 or S117, when the time Rf counted by the Rf timer 49 has exceeded the threshold value set by the threshold value setting section 53, a determination is made to effect flushing operation (step S118).

A threshold value "Rf*−Ct−2WAIT" required when the carriage 11 is about to move from right to left in the next print cycle (or when the carriage 11 is about to move from the home position) becomes smaller than the threshold value "Rf*" required when the carriage 11 is about to move from left to right, the time Rf counted by the Rf timer 49 exceeds the threshold value within a short period of time. Hence, there is increased the probability of flushing the recording heads 12*a* and 12*b* at the home position located at the right-hand. Thus, throughput can be improved. The parameter WAIT is doubled in order to ensure margins. Hence, the parameter WAIT can be set to an appropriate scaling factor.

In order to prevent occurrence of print failures, a flushing operation required during a print period must be effected within a maximum period of 12.4 seconds. The determination operation will be described more specifically by means of taking the following printer as an example. In the printer, when a carriage travel speed V in a high-quality print mode is set to 200 cps and when a carriage travel speed V in a draft-print mode is set to 300 cps, the travel time Ct required for the carriage 11 to print one path assumes values shown in Table 2 according to the size (width W) of paper.

TABLE 2

| paper size | paper width W (mm) | Ct (sec) V = 200 (cps) | Ct (sec) V = 300 (cps) |
|---|---|---|---|
| A0 | 1040 | 2.0 | 1.4 |
| A1 | 600 | 1.2 | 0.8 |
| A2 | 520 | 1.0 | 0.7 |
| A3 | 300 | 0.6 | 0.4 |
| A4 | 210 | 0.4 | 0.3 |
| A5 | 150 | 0.3 | 0.2 |

When A0-size recording paper is loaded on the recording apparatus and a print mode is specified to a high-quality print mode, the setting section 51 takes a value of 2.0 (sec) as the carriage travel time Ct from the print mode and the paper width output from the paper width recognizer 48. Further, the setting section 51 selects a value of 10.4 (sec) as the reference time Rf* (step S114).

When the carriage traveling direction detector 54 determines that the carriage 11 is about to move from right to left; that is, from the home position (step S115), the threshold value setting section 53 sets a threshold value "Rf*−Ct−2WAIT"=(10.4−2.0−2WAIT)=(8.4−2WAIT). The flushing setting section 55 compares the threshold value "Rf*−Ct−2WAIT" with the time Rf counted by the Rf timer 49 (step S116).

In this case, a first path is printed, and hence the time RF counted by the Rf timer 49 has not exceeded the threshold value (8.4−2WAIT). Hence, printing is commenced without execution of a flushing operation. When the recording head 11 has moved to the left-hand end after completion of printing for one path, the threshold value setting section 53 sets a threshold value at which there is obtained Rf*=10.4 (sec). Further, the flushing determination section 55 compares the threshold value "10.4+2.0 (sec)" with the time Rf counted by the Rf timer 49 (step S117).

During a printing operation in which the carriage 11 effects printing operation from the home position, when the time Rf counted by the Rf timer 49 has exceeded "8.4−2WAIT" (sec), a flushing operation is determined (step S118). As a result, flushing operation is performed by way of processes described in the flowcharts shown in FIGS. 6 and 7.

When the time Rf counted by the Rf timer 49 has elapsed 10.4 (sec) during the printing operation effected from the home position, a flushing operation is determined (step S118). Flushing operation is performed by way of processes provided in the flowcharts shown in FIGS. 6 and 7.

Even in a printing operation in which data are printed on another paper or in another print mode, the reference value Rf* is set as a difference between the longest flushing cycle T and the travel time Ct required for the carriage 11 to print one path. When printing is commenced from the end opposite the end located at the home position, flushing operation can be performed before the longest flushing cycle T arises during a printing operation.

The longest flushing cycle T is a time period during which is ejecting failure of ink droplets; for example, occurrence of a deviated flight of ink droplets., would arise if another flushing operation is performed from when a previous flushing operation is completed until at least time T has arrived.

For example, when the carriage 11 is traveling at a speed of 200 cps over the width of A0-size paper, the reference value Rf* assumes a value of 10.4 seconds as can be seen from Table 1. Further, when the Rf timer 49 has counted 10.3 seconds as a measured time Rf and printing is about to be started from the end opposite the home position, the measured time Rf has not exceeded the reference value Rf*=10.4 seconds. Hence, NO is selected in step S117 as a result of determination, and no flushing operation is performed.

Since the travel time Ct of the carriage 11 assumes a value of 2.0 seconds, the Rf timer 49 counts a time Rf=12.3 seconds when the carriage 11 has arrived at the home position. Accordingly, no timeout arises, which would otherwise be caused when the Rf timer 49 counts a time T during a printing operation, regardless of the travel speed of the carriage 11 and of a paper width. Hence, failures to eject ink droplets do not arise.

When printing is started from the home position, (Rf*−Ct−2WAIT) is set as a threshold value. The threshold value (Rf*−Ct−2WAIT) is changed by means of the carriage travel time Ct and the reference value Rf*, in accordance with the width of recording paper loaded in the recording apparatus and a print mode.

In contrast with a case where printing is started from the end opposite the home position to the home position, the threshold value is set so as to assume a value which is smaller by only (Ct+2WAIT). Hence, the possibility of determining whether or not flushing operation is to be performed in the area close to the home position is increased.

For this reason, printing is effected while the end located at the home position is taken as a reference. Hence, even when a point in time, at which the next print start-up instruction is to be issued, becomes unknown as a result of clogging of data output from the host and when the first and second heads 12*a* and 12*b* await print data at the home position, the possibility of making a determination as to whether or not flushing operation is to be performed at the home position becomes high. As a result, throughput of the recording apparatus is improved. Particularly, in the case of print data pertaining to an image whose width is smaller than physical width of recording paper loaded in the recording apparatus, throughput of the recording apparatus is greatly improved.

In other words, when the width of an image to be printed is substantially identical with the width of recording paper, a greater reference value Rf* is set as the travel speed of the carriage 11 becomes faster. Further, the carriage travel time Ct becomes shorter, and hence the frequency of flushing operation is decreased, thus improving throughput of the recording apparatus. On the contrary, as the travel speed of the carriage 11 becomes slower, the travel time Ct becomes longer. Hence, the frequency of flushing operation is increased, thus ensuring the reliability of printing operation.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

an ink jet recording head mounted on a carriage reciprocatively moving in a width direction of a loaded recording medium having a printing region on which image is recorded;

at least one flushing region situated at least one of opposite side ends of the printing region, in which a flushing operation of the recording head is performed;

means for setting a reference value which is determined in accordance with a first time period required for the carriage to travel a width dimension of the loaded recording medium;

means for setting a threshold value, which is used for determining whether the flushing operation is performed, in accordance with the reference value;

a timer which is reset when the flushing operation is performed; and means for determining whether the flushing operation is performed by comparing the threshold value and a time period counted by the timer.

2. The ink jet recording apparatus as set forth in claim 1, wherein the reference value is determined in accordance with the width dimension of the loaded recording medium.

3. The ink jet recording apparatus as set forth in claim 1, wherein the reference value is determined in accordance with a moving speed of the carriage.

4. The ink jet recording apparatus as set forth in claim 1, wherein the reference value is determined in accordance with a second time period which is obtained by subtracting the first time period from a maximum time interval between succeeding flushing operations.

5. The ink jet recording apparatus as set forth in claim 1, wherein the recording medium is loaded such that a reference position thereof is placed in a side of which a home position of the carriage is situated;

wherein the threshold value determination means has different threshold values in accordance with the moving direction of the carriage; and wherein a first threshold value used for a printing when the carriage moves from the home position is smaller than a second threshold value used for a printing when the carriage moves toward the home position.

6. The ink jet recording apparatus as set forth in claim 5, wherein the first threshold value is obtained by subtracting a predetermined value from the reference value.

7. The ink jet recording apparatus as set forth in claim 6, wherein the predetermined value includes a time period during which the movement of the carriage is paused.

8. The ink jet recording apparatus as set forth in claim 1, wherein the at least one flushing region includes a first flushing region which is situated in one side end of the printing region where a home position of the carriage is placed, and a second flushing region which is situated in the other side end of the printing region; and wherein the recording apparatus further comprises means for selecting the first flushing region or the second flushing region where the flushing operation is performed when the flushing operation determination means determines the flushing operation is required.

9. An ink jet recording apparatus comprising:

an ink jet recording head, mounted on a carriage reciprocatively moving in a width direction of a loaded recording medium having a printing region on which an image is recorded;

at least one flushing region, disposed at least one of opposite side ends of the printing region, in which a flushing operation of the recording head is performed;

a reference provider, which provides a reference value which is determined in accordance with a first time period required for the carriage to travel a width dimension of the loaded recording medium;

a threshold provider, which provides a threshold value, which is used for determining whether the flushing operation is performed, in accordance with the reference value;

a timer, which is reset when the flushing operation is performed; and a flushing controller, which determines whether the flushing operation is performed based on the threshold value and a time period counted by the timer.

10. The ink jet recording apparatus as set forth in claim 9, wherein the reference value is determined in accordance with the width dimension of the loaded recording medium.

11. The ink jet recording apparatus as set forth in claim 9, wherein the reference value is determined in accordance with a moving speed of the carriage.

12. The ink jet recording apparatus as set forth in claim 9, wherein the reference value is determined in accordance with a second time period which is obtained by subtracting the first time period from a maximum time interval between succeeding flushing operations.

13. The ink jet recording apparatus as set forth in claim 9, wherein the recording medium is loaded such that a reference position thereof is placed in a side of which a home position of the carriage is situated;

wherein the threshold value provider provides different threshold values in accordance with the moving direction of the carriage; and wherein a first threshold value used for a printing when the carriage moves from the home position is smaller than a second threshold value used for a printing when the carriage moves toward the home position.

14. The ink jet recording apparatus as set forth in claim 13, wherein the first threshold value is obtained by subtracting a predetermined value from the reference value.

15. The ink jet recording apparatus as set forth in claim 14, wherein the predetermined value includes a time period during which the movement of the carriage is paused.

16. The ink jet recording apparatus as set forth in claim 9, wherein the at least one flushing region includes a first flushing region which is situated in one side end of the printing region where a home position of the carriage is placed, and a second flushing region which is situated in the other side end of the printing region; and wherein the recording apparatus further comprises a selector which selects the first flushing region or the second flushing region where the flushing operation is performed when the flushing controller determines the flushing operation is required.

17. A flushing control method used for an ink jet recording apparatus having an ink jet recording head, mounted on a carriage reciprocatively moving in a width direction of a loaded recording medium having a printing region on which an image is recorded; and at least one flushing region, disposed at least one of opposite side ends of the printing region, in which a flushing operation of the recording head is performed, the method comprising the steps of:

providing a reference value which is determined in accordance with a first time period required for the carriage to travel a width dimension of the loaded recording medium;

providing a threshold value, which is used for determining whether the flushing operation is performed, in accordance with the reference value;

counting a time period since a previous flushing operation was performed; and determining whether a present flushing operation is performed based on the threshold value and the time period.

18. The flushing method as set forth in claim 17, wherein the reference value is determined in accordance with the width dimension of the loaded recording medium.

19. The flushing control method as set forth in claim 17, wherein the reference value is determined in accordance with a moving speed of the carriage.

20. The flushing control method as set forth in claim 17, wherein the reference value is determined in accordance with a second time period which is obtained by subtracting the first time period from a maximum time interval between succeeding flushing operations.

21. The flushing control method as set forth in claim 17, wherein the recording medium is loaded such that a reference position thereof is placed in a side of which a home position of the carriage is situated;

wherein different threshold values are provided in accordance with the moving direction of the carriage; and wherein a first threshold value used for a printing when the carriage moves from the home position is smaller than a second threshold value used for a printing when the carriage moves toward the home position.

22. The flushing control method as set forth in claim 21, wherein the first threshold value is obtained by subtracting a predetermined value from the reference value.

23. The flushing control method as set forth in claim 22, wherein the perdetermined value includes a time period during which the movement of the carriage is paused.

24. The ink jet recording apparatus as set forth in claim 23, wherein the at least one flushing region includes a first flushing region which is situated in one side end of the printing region where a home position of the carriage is placed, and a second flushing region which is situated in the other side end of the printing region; and wherein the recording apparatus further comprises means for selecting the first flushing region or the second flushing region where the flushing operation is performed when it is determined that the flushing operation is required.

25. The flushing control method as set forth in claim 17, wherein the at least one flushing region includes a first flushing region which is situated in one side end of the printing region where a home position of the carriage is placed, and a second flushing region which is situated in the other side end of the printing region; and wherein the method further comprises the step of selecting the first flushing region or the second flushing region where the flushing operation is performed when the flushing controller determines the flushing operation is required.

26. A flushing controller incorporated in an ink jet recording apparatus having an ink jet recording head, mounted on a carriage reciprocatively moving in a width direction of a loaded recording medium having a printing region on which an image is recorded; and at least one flushing region, disposed at least one of opposite side ends of the printing region, in which a flushing operation of the recording head is performed, the flushing controller comprising:

a reference provider, which provides a reference value which is determined in accordance with a first time period required for the carriage to travel a width dimension of the loaded recording medium;

a threshold provider, which provides a threshold value, which is used for determining whether the flushing operation is performed, in accordance with the reference value; and a timer, which is reset when the flushing operation is performed, wherein the flushing controller determines whether the flushing operation is performed based on the threshold value and a time period counted by the timer.

27. The flushing controller as set forth in claim 26, wherein the reference value is determined in accordance with the width dimension of the loaded recording medium.

28. The flushing controller as set forth in claim 26, wherein the reference value is determined in accordance with a moving speed of the carriage.

29. The flushing controller as set forth in claim 26, wherein the reference value is determined in accordance with a second time period which is obtained by subtracting the first time period from a maximum time interval between succeeding flushing operations.

30. The flushing controller as set forth in claim 26, wherein the recording medium is loaded such that a reference position thereof is placed in a side of which a home position of the carriage is situated;

wherein the threshold value provider provides different threshold values in accordance with the moving direction of the carriage; and wherein a first threshold value used for a printing when the carriage moves from the home position is smaller than a second threshold value used for a printing when the carriage moves toward the home position.

31. The flushing controller as set forth in claim 30, wherein the first threshold value is obtained by subtracting a predetermined value from the reference value.

32. The flushing controller as set forth in claim 31,, wherein the predetermined value includes a time period during which the movement of the carriage is paused.

33. The flushing controller as set forth in claim 26, wherein the at least one flushing region includes a first flushing region which is situated in one side end of the printing region where a home position of the carriage is placed, and a second flushing region which is situated in the other side end of the printing region; and wherein the flushing controller further comprises a selector which selects the first flushing region or the second flushing region where the flushing operation is performed when the flushing controller determines the flushing operation is required.

34. An ink jet recording apparatus comprising:

an ink jet recording head mounted on a carriage reciprocatively moving in a width direction of a loaded recording medium having a printing region on which an image is recorded;

at least one flushing region disposed at least one of opposite side ends of the printing region, in which a flushing operation of the recording head is performed;

a paper width detector, which detects a width dimension of the recording medium;

a threshold provider, which provides a plurality of threshold values determined in accordance with the width dimension of the recording medium;

a timer which is reset when the flushing operation is performed; and a flushing controller, which determines whether the flushing operation is performed based on one of the threshold values according to the width dimension of the recording medium and a time period counted by the timer.

35. The ink jet recording apparatus as set forth in claim 34, further comprising a reference provider, which provides a reference value becoming smaller while the width dimension of the recording medium becomes larger, wherein the threshold values are calculated based on the reference value.

36. The ink jet recording apparatus as set forth in claim 34, wherein the paper width detector includes:

a physical paper width detector, which physically detects the width of the recording medium; and a logical paper width detector, which logically detects the width of the recording medium from an input data into a printer driver, wherein the paper width detector selects data having smaller width value from the width data detected by the physical paper width detector and the logical paper width detector.

37. A flushing control method used for an ink jet recording apparatus having an ink jet recording head mounted on a carriage reciprocatively moving in a width direction of a loaded recording medium having a printing region on which an image is recorded; and at least one flushing region disposed at least one of opposite side ends of the printing region, in which a flushing operation of the recording head is performed, the method comprising the steps of:

detecting a width dimension of the recording medium;

providing a plurality of threshold values determined in accordance with the width dimension of the recording medium;

counting a time period since a previous flushing operation was performed; and determining whether a present flushing operation is performed based on one of the threshold values according to the width dimension of the recording medium and the time period.

38. The flushing control method as set forth in claim 37, further comprising the steps of:

providing a reference value becoming smaller while the width dimension of the recording medium becomes larger; and calculating the threshold values based on the reference value.

39. The flushing control method as set forth in claim 37, further comprising the steps of:

detecting physically the width of the recording medium;

detecting logically the width of the recording medium from an input data into a printer driver; and selecting data having smaller width value from the physically detected width data and the logically detected paper width.

40. A flushing controller incorporated in an ink jet recording apparatus having an ink jet recording head mounted on a carriage reciprocatively moving in a width direction of a loaded recording medium having a printing region on which an image is recorded; and at least one flushing region disposed at least one of opposite side ends of the printing region, in which a flushing operation of the recording head is performed, the flushing controller comprising:

a paper width detector, which detects a width dimension of the recording medium;

a threshold provider, which provides a plurality of threshold values determined in accordance with the width dimension of the recording medium; and a timer which is reset when the flushing operation is performed, wherein the flushing controller determines whether the flushing operation is performed based on one of the threshold values according to the width dimension of the recording medium and a time period counted by the timer.

41. The flushing controller as set forth in claim 40, further comprising a reference provider, which provides a reference value becoming smaller while the width dimension of the recording medium becomes larger, wherein the threshold values are calculated based on the reference value.

42. The flushing controller as set forth in claim 40, wherein the paper width detector includes:

a physical paper width detector, which physically detects the width of the recording medium; and a logical paper width detector, which logically detects the width of the recording medium from an input data into a printer driver, wherein the paper width detector selects data having smaller width value from the width data detected by the physical paper width detector and the logical paper width detector.

* * * * *

UNITED STATES PATENT AND TRADEMARK OFFICE

CERTIFICATE OF CORRECTION

PATENT NO. : 6,663,216 B2
DATED : December 16, 2003
INVENTOR(S) : Munehide Kanaya It is certified that error appears in the above-identified patent and that said Letters Patent is hereby corrected as shown below:

Title page,
Item [*], Notice, please delete the following:
"This patent is subject to a terminal disclaimer."

Signed and Sealed this

Twenty-seventh Day of July, 2004

JON W. DUDAS
*Acting Director of the United States Patent and Trademark Office*